US006871935B2

(12) United States Patent
Harrison et al.

(10) Patent No.: US 6,871,935 B2
(45) Date of Patent: Mar. 29, 2005

(54) PRINTER HEAD CLEANING SYSTEM AND METHOD

(75) Inventors: Mark A. Harrison, Mechanicsville, VA (US); Mike Thompson, Mechanicsville, VA (US); Charles L. Stiff, Mechanicsville, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/366,962

(22) Filed: Feb. 14, 2003

(65) Prior Publication Data

US 2004/0160474 A1 Aug. 19, 2004

(51) Int. Cl.[7] ..... B41J 2/165
(52) U.S. Cl. ..... 347/25; 347/28
(58) Field of Search ..... 347/22, 24–29

(56) References Cited

U.S. PATENT DOCUMENTS 5,559,536 A * 9/1996 Saito et al. ..... 347/25
5,786,829 A * 7/1998 Pasciak et al. ..... 347/28
5,793,389 A * 8/1998 Mitchell ..... 347/28
5,929,877 A * 7/1999 Hetzer et al. ..... 347/28
6,196,657 B1 * 3/2001 Hawkins et al. ..... 347/28

FOREIGN PATENT DOCUMENTS

JP 361193857 A * 8/1986 ..... 347/28
WO WO 99/51498 10/1999
WO WO 99/51500 10/1999

* cited by examiner

*Primary Examiner*—Shih-wen Hsieh
(74) *Attorney, Agent, or Firm*—Burns, Doane, Swecker & Mathis, LLP

(57) ABSTRACT

A printer head cleaning system for cleaning a printer head, such as a video inkjet printer head reduces exposure of personnel to hazardous solvent vapors by containing and evacuating evaporated cleaning solvent vapors. The printer head cleaning system includes a printer head drying fixture configured to receive a printer head in an interior of the fixture and a vapor capture device for drawing air through the fixture and past the printer head to evaporate and evacuate vapors of the cleaning solution from the printer head. The fixture includes a first end, a second end, a port for receiving the printer head, and a fluid path within the interior of the fixture from the first end to the second end which passes around the printer head when the printer head is received in the fixture.

19 Claims, 3 Drawing Sheets

PRINTER HEAD CLEANING SYSTEM AND METHOD

FIELD OF THE INVENTION

The invention relates to a system for cleaning printer heads, and more particularly, the invention relates to a vapor control system for cleaning a video ink jet printer head and a method for cleaning a video ink jet printer head.

BACKGROUND OF THE INVENTION

Video ink jet printers are used throughout the packaging field to print information concerning a product on product packages in many different industries. For example, information including product names, identification numbers, automatic production counts, time and date of manufacture, location of manufacture, expiration date, or other encoded information can be printed on the outer portion of the packaging. Video ink jet printers may be mounted on a production line to mark products at high speed as they pass along the production line. Examples of ink jet coder systems for cigarette packages and cigarette cartons are described in WO 99/51500 and WO 99/51498 which are incorporated herein by reference.

Examples of some of the video ink jet printers which are available for printing on products in production lines are those manufactured by Marconi Data Systems Inc. The ink jet heads of these printers and other printers require periodic maintenance and cleaning to remove dried ink. To clean the printer heads the heads are generally removed from the printer, rinsed with a cleaning solution including various solvents, and then dried with compressed air to remove the cleaning solution. During rinsing, the printer head is generally held over a tray or sink and sprayed with the cleaning solution. Excess cleaning solution is collected in the tray or sink below the printer head. The evaporation of the cleaning solution from the printer head and the tray or sink during the drying process may expose personnel to solvent vapors.

The cleaning solutions include one or more solvents, such as acetone, ethanol, and other chemicals for which OSHA has defined permissible exposure limits. The exposure of the personnel performing the cleaning to OSHA regulated chemicals can be reduced by the use of respiratory protection equipment. However, other personnel in the vicinity may not be protected. In addition, the respiratory protection equipment is cumbersome and uncomfortable to wear.

It would be desirable to provide a system and method to limit exposure of all personnel to solvents during the cleaning of printer heads without requiring the use of respiratory protection equipment.

SUMMARY OF THE INVENTION

The present invention relates to a vapor control system for cleaning a video ink jet printer head and a method for cleaning a video ink jet printer head which reduces exposure to hazardous solvent vapors.

In accordance with one aspect of the present invention, a printer head cleaning system includes a printer head drying fixture configured to receive a printer head in an interior of the fixture and a vapor capture device. The fixture includes a first end, a second end, a port for receiving a printer head, and a fluid path within the interior of the fixture from the first end to the second end which passes around the printer head when the printer head is received in the fixture. The first end of the fixture has at least one opening for allowing air to pass from the exterior to the interior of the fixture. The vapor capture device is attached to the second end of the fixture for drawing air through the at least one opening and past the printer head to evaporate and evacuate vapors of cleaning solution from the printer head.

In accordance with another aspect of the present invention, a printer head drying fixture includes a fixture body configured to receive a printer head in an interior of the fixture, a first end, a second end, a port for receiving a printer head, at least one opening at the first end for allowing air to pass from the exterior to the interior of the fixture, and a fluid path within the interior of the fixture from the at least one opening to the second end which passes around the printer head when the printer head is received in the fixture.

In accordance with a further aspect of the present invention a method of cleaning a printer head includes the steps of: applying a liquid cleaning solution to the printer head; providing a fixture configured to receive the printer head in an interior of the fixture; positioning the printer head and the fixture such that the printer head is inside the fixture; and drawing air through the fixture to evaporate and evacuate the cleaning solution from the printer head.

BRIEF DESCRIPTION OF THE DRAWING FIGURES

The invention will now be described in greater detail with reference to the preferred embodiments illustrated in the accompanying drawings, in which like elements bear like reference numerals, and wherein.

DETAILED DESCRIPTION OF THE INVENTION

Figure 1:
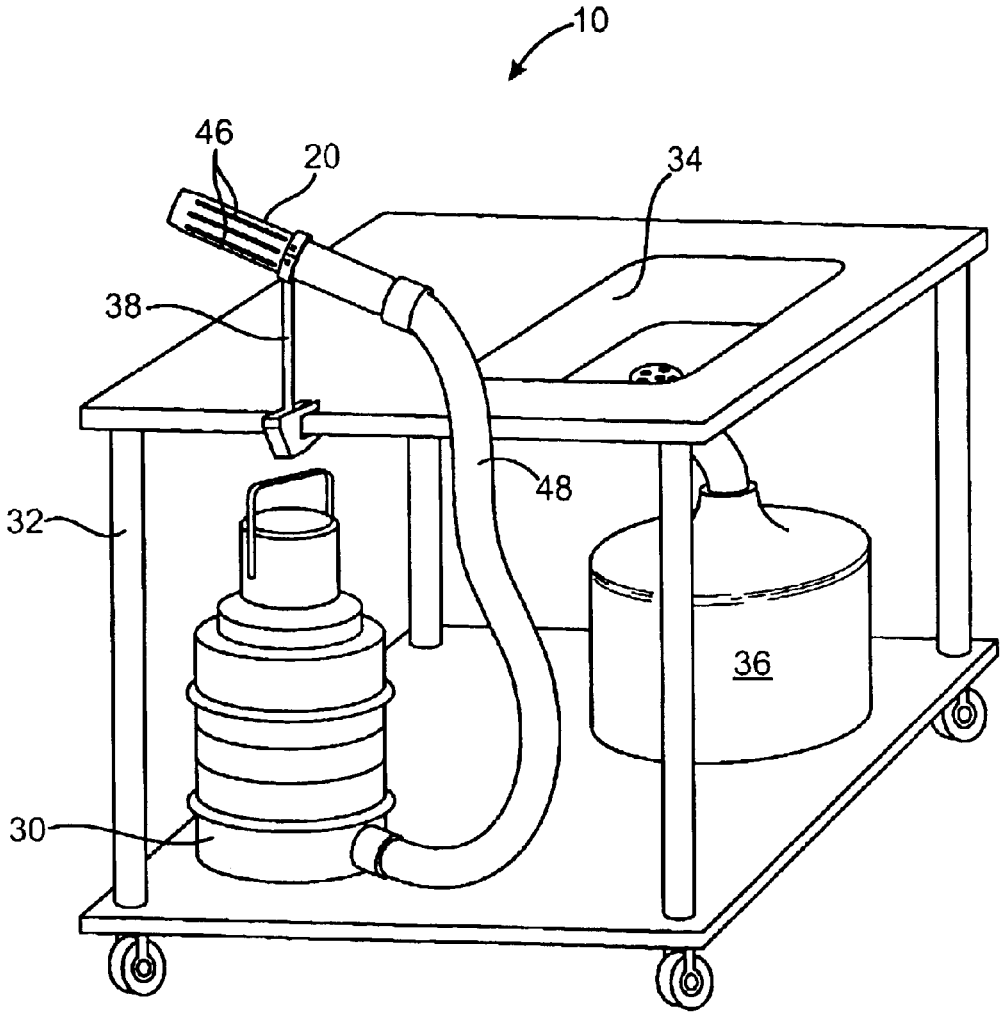
FIG. 1 is perspective view of a printer head cleaning system.

A printer head cleaning system for cleaning a printer head, such as a video ink jet printer head, is shown by way of example in FIG. 1. The printer head cleaning system reduces exposure of personnel to hazardous solvent vapors by containing and evacuating evaporated cleaning solvent vapors.

One example of a printer head cleaning system 10, shown in FIG. 1 includes a printer head drying fixture 20, and a vapor capture device 30 connected to the drying fixture. The drying fixture 20 and the vapor capture device 30 are preferably positioned on a wheeled cart 32 so that the system 10 can be easily moved for cleaning various printer heads used in one manufacturing facility. The system 10 may also include a cleaning solution collection sink 34 or tray and a cleaning solution collection drum 36 connected to the drain of the sink.

Figure 2:
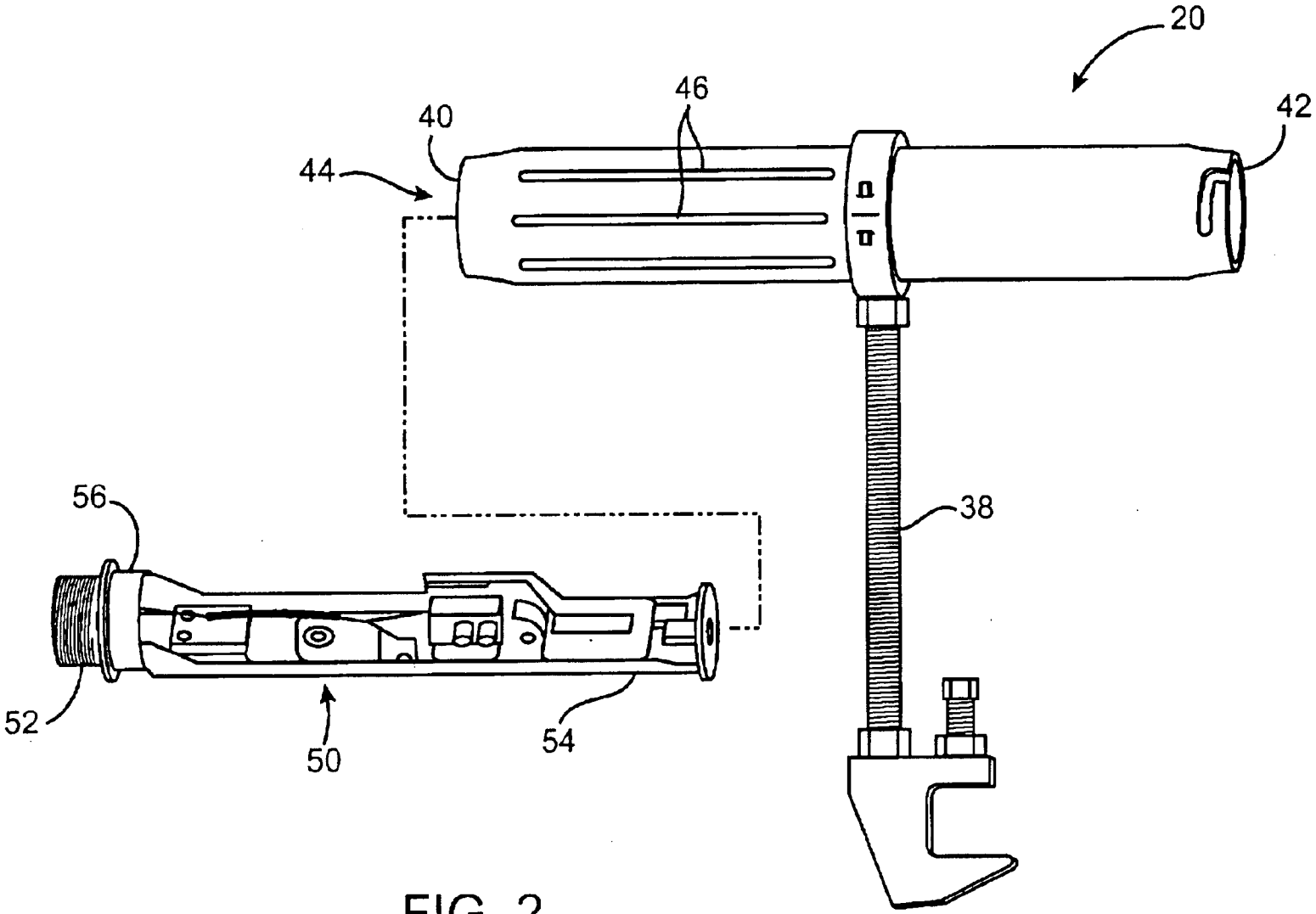
FIG. 2 is a perspective view of a printer head and a printer head drying fixture.
Figure 3:
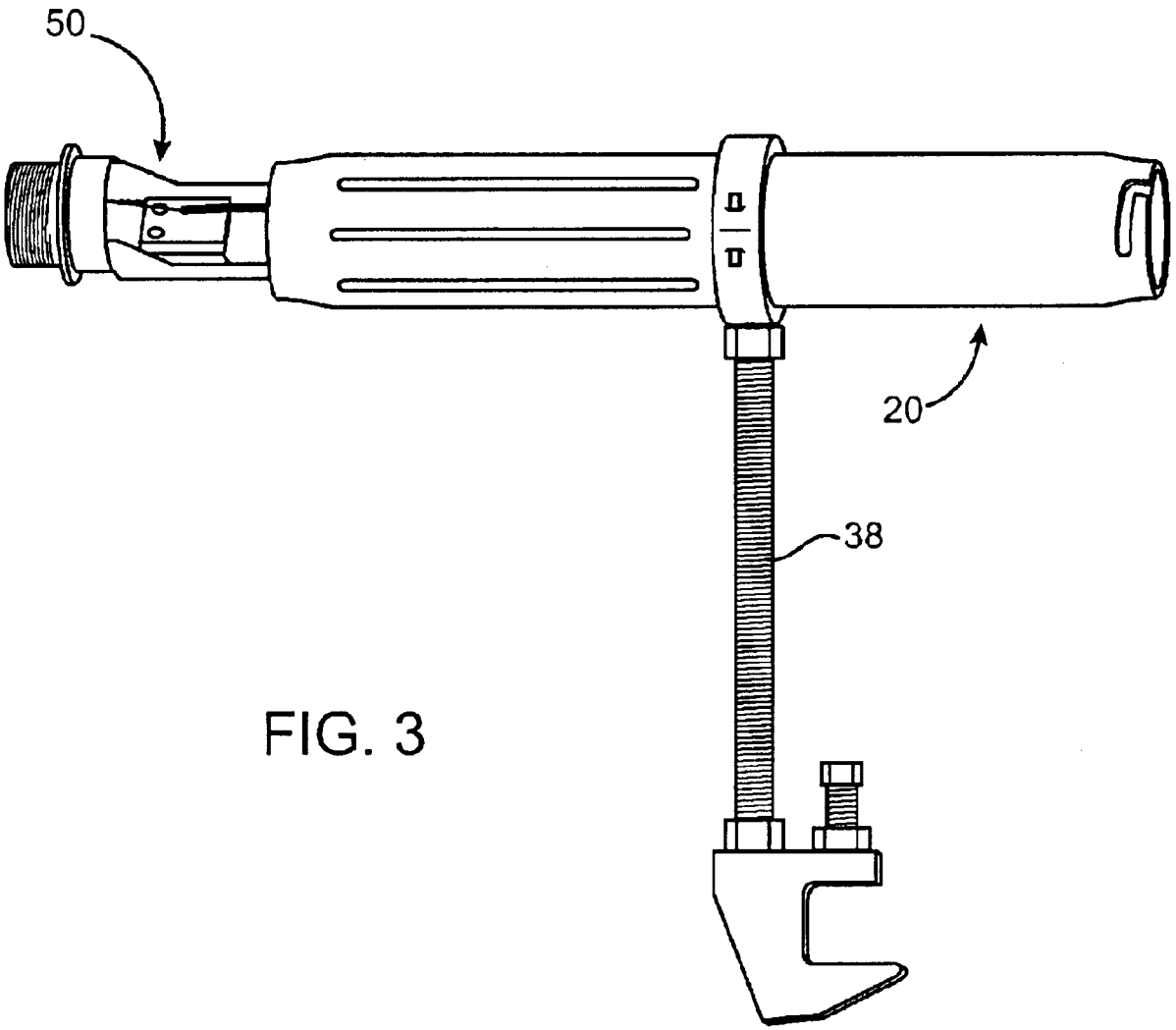
FIG. 3 is a perspective view of the printer head inside the printer head drying fixture.

The printer head drying fixture 20 is configured to receive a printer head 50, shown in FIGS. 2 and 3, for evaporating and evacuating the cleaning solution off of the printer head. The fixture 20 may be mounted by an attachment arm 38 onto the cart 32.

As shown in FIG. 2, the fixture 20 includes a first end 40, a second end 42, and a port 44 for receiving a printer head 50. In the embodiment of the fixture 20 shown, the fixture is substantially cylindrical with the cylinder providing a fluid path within the interior of the fixture from the first end 40 to the second end 42 which passes around the printer head 50 when the printer head is received in the fixture. The first end 40 of the fixture 20 includes at least one and preferably a plurality of openings 46 for allowing air to pass from the exterior to the interior of the fixture.

The vapor capture device 30 is attached to the second end 42 of the fixture 20 by a vacuum hose 48. The vapor capture device 30 draws air through the openings 46 and past the printer head 50 to evaporate and evacuate vapors of cleaning solution from the printer head. The vapor capture device 30 includes a filter media, such as an activated carbon or charcoal filter for removing hazardous vapors from the air stream. Such hazardous vapor removal vacuum devices are known to those in the art and are available from Nilfisk. The fixture 20 and vapor capture device 30 can obviate drying the cleaned printer head 50 with compressed air and thus avoid releasing significant amounts of solvent vapors into the surrounding environment.

As shown in FIG. 2, one example of a printer head 50 is an elongated member with a threaded first end 52 for connection to the printer (not shown). The printer head 50 has a printer jet nozzle at a second end 54 which typically becomes clogged by dried ink.

The printer head drying fixture 20 of FIGS. 2 and 3 is substantially cylindrical to receive the printer head 50 illustrated. However, the fixture shape may be varied to accommodate printer heads of other shapes. The fixture 20 includes the plurality of openings 46 which are in the form of longitudinal slots. The openings 46 are machined into the tubular fixture and provide ventilation/dilution openings for allowing air to pass into the fixture and around the printer head 50. However, other shaped openings, such as circular or other holes may also be used. Although the openings 46 have been illustrated along the side surface of the fixture 20, the openings may alternatively be formed in an end of the fixture, or between the fixture and the printer head 50. Still yet, the openings could be eliminated and/or air could be blown into the printer fixture to dry the printer head and direct solvent vapors into the vapor capture device.

When the printer head 50 is positioned in the fixture 20, the openings 46 and the connection to the hose of the vapor capture device 30 are preferably located on opposite sides of the printer jet nozzle so that the air and vapors are drawn along a fluid path which passes and surrounds the printer jet nozzle of the printer head. The air flow through the fixture 20 effects evaporation of the cleaning solution and allows quick drying of the printer head 50 allowing the printer head to be cleaned and returned to the printer quickly while minimizing exposure to personnel high levels of harmful solvent vapors.

The fixture 20 is attached to the cart 32 by the attachment arm 38 and oriented at an angle with respect to vertical, such as about 40°, which allows placement of the printer head 50 into the fixture so that a flange 56 on the first end 52 of the printer head rests on the first-end 40 of the fixture. The angled orientation of the fixture 20 retains the printer head 50 without the need for a retainer or locking mechanism. However, other orientations or arrangements can be used for retaining the printer head 50 in the fixture such as a resilient retainer or locking mechanism may also be used.

To accommodate the printer head 50 which is illustrated, the fixture is about 5–15 inches long and about 1–5 inches in diameter, and preferably about 9 inches long and about 1.25 inches in diameter. The openings 46 extend along about ½ of the length of the fixture 20 and are substantially evenly distributed around the circumference of the fixture.

According to one embodiment of the invention, a printer head 50 is cleaned by the steps of the following method. The printer head 50 to be cleaned is removed from the printer for cleaning and a liquid cleaning solution is applied to the printer head. The printer head cleaning may be performed on a regular maintenance schedule or when poor quality printing is detected. The cleaning solution may be applied by a squirt bottle, sprayer, or other method and the excess cleaning solution is collected in the sink 34 on the cart 32. The potential for worker exposure to solvent vapors during the application of the cleaning solution is minimal since evaporation is dependent on ambient environmental conditions. The printer head 50 is then placed in the fixture 20 and air is drawn through the fixture by a vacuum created by the vapor capture device 30 to evaporate and evacuate the cleaning solution from the printer head. The application of the vacuum to the fixture 20 speeds the drying of the printer head 50 and functions in the same manner as drying by the use of compressed air except that evaporated solvent vapor is contained. Finally, the clean and dry printer head 50 is removed from the fixture 20 and returned to the printer.

According to an alternative method, the printer head 50 may be fixed in place and the fixture 20 may be placed over the printer head for drying of the printer head.

The system and method of the present invention will significantly reduce or eliminate the potential for over exposure to OSHA regulated chemicals during the video ink jet cleaning process. The device will likely remove the necessity for the employee performing the cleaning operation to wear respiratory protection equipment and will protect other personnel from exposure.

The significant reduction in solvent vapors released into the production area will provide the added benefit of preventing the solvent from contaminating the product, being absorbed by the product or otherwise altering the desired characteristics of the product. The products which may be effected by solvent vapors in the production area include tobacco, food products, and other products.

While the invention has been described in detail with reference to the preferred embodiments thereof, it will be apparent to one skilled in the art that various changes and modifications can be made and equivalents employed, without departing from the present invention.

What is claimed is:

1. A printer head cleaning system comprising:

a printer head drying fixture configured to receive a printer head in an interior of the fixture, the fixture including a first end, a second end, a port for receiving a printer head, and a fluid path within the interior of the fixture from the first end to the second end which passes around the printer head when the printer head is received in the fixture; and a vapor capture device attached to the second end of the fixture for drawing air through the at least one opening and past the printer head to evaporate and evacuate vapors of a cleaning solution from the printer head.

2. The printer head cleaning system of claim 1, wherein the fixture is a tubular fixture, and the port for inserting the printer head is at the first end of the tubular fixture.

3. The printer head cleaning system of claim 1, wherein the first end of the fixture has a least one opening for allowing air to pass from the exterior to the interior of the fixture.

4. The printer head cleaning system of claim 3, wherein the at least one opening comprises a plurality of slots.

5. The printer head cleaning system of claim 1, wherein the fixture is mounted on a support at an orientation such that the port for inserting the printer head is on an upper portion of the device.

6. The printer head cleaning system of claim 1, wherein the fixture and the vapor capture device are mounted on a portable cart.

7. The printer head cleaning system of claim 6, wherein the cart further comprises a waste collection device for collecting liquid cleaning solution applied to the printer head.

8. The printer head cleaning system of claim 1, wherein the vapor capture device includes a charcoal filter which removes volatile organic compounds from an air stream passing through the fixture.

9. A printer head drying fixture comprising:

a fixture body configured to receive a printer head in an interior of the fixture;

a first end of the fixture body;

a second end of the fixture body;

a port for receiving a printer head;

at least one opening at the first end for allowing air to pass from an exterior to the interior of the fixture; and a fluid path within the interior of the fixture from the at least one opening to the second end which passes around the printer head when the printer head is received in the fixture.

10. The printer head drying fixture of claim 9, wherein the fixture body is tubular and the port for receiving the printer head is at the first end of the fixture body.

11. The printer head drying fixture of claim 9, wherein the at least one opening comprises a plurality of slots.

12. The printer head drying fixture of claim 9, wherein the fixture is mounted such that the port for receiving the printer head is on an upper portion of the device.

13. A method of cleaning a printer head comprising:

applying a liquid cleaning solution to the printer head;

providing a fixture configured to receive the printer head in an interior of the fixture;

positioning the printer head and the fixture such that the printer head is inside the fixture; and drawing air through the fixture to evaporate and evacuate the cleaning solution from the printer head, wherein the cleaning occurs in a printer head cleaning system comprising:

a printer head drying fixture configured to receive a printer head in an interior of the fixture, the fixture including a first end, a second end, a port for receiving a printer head, and a fluid path within the interior of the fixture from the first end to the second end which passes around the printer head when the printer head is received in the fixture; and a vapor capture device attached to the second end of the fixture for drawing air through at least one opening and past the printer head to evaporate and evacuate vapors of a cleaning solution from the printer head.

14. The method of claim 13, wherein the printer head is placed inside the fixture.

15. The method of claim 13, wherein the fixture is placed over the printer head.

16. The method of claim 13, wherein the evacuated cleaning solution is passed through a filter which removes volatile organic compounds from an air stream passed through the fixture.

17. The method of claim 16, wherein the filter is a charcoal filter.

18. The method of claim 13, wherein the liquid cleaning solution applied comprises at least one of acetone and ethanol.

19. A method of cleaning a printer head comprising:

applying a liquid cleaning solution to the printer head;

providing a fixture configured to receive the printer head in an interior of the fixture;

positioning the printer head and the fixture such that the printer head is inside the fixture;

drawing air through the fixture to evaporate and evacuate the cleaning solution from the printer head;

wherein the printer head is placed inside the fixture;

removing the printer head from a printer prior to applying the liquid cleaning solution; and replacing the printer head on the printer after evaporating and evacuating the cleaning solution.

* * * * *